US006542703B1

(12) United States Patent
Jung

(10) Patent No.: US 6,542,703 B1
(45) Date of Patent: Apr. 1, 2003

(54) METHOD FOR IMPROVING THE PRINT QUALITY OF AN IMAGE FORMING APPARATUS

(75) Inventor: Su-Jong Jung, Kumi-shi (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/611,960

(22) Filed: Jul. 6, 2000

(30) Foreign Application Priority Data

Jul. 7, 1999 (KR) ..... 99-27210

(51) Int. Cl.[7] ..... G03G 15/00

(52) U.S. Cl. ..... 399/44; 399/97; 399/66; 399/68; 399/396

(58) Field of Search ..... 399/38, 44, 94, 399/97, 66, 396, 67, 68, 388

(56) References Cited

U.S. PATENT DOCUMENTS 4,618,242 A * 10/1986 Yamagishi ..... 399/67
5,170,215 A * 12/1992 Pfeuffer ..... 399/67
5,819,149 A * 10/1998 Watanabe et al. ..... 399/330
5,887,220 A * 3/1999 Nagaoka ..... 399/46
6,047,144 A * 4/2000 Sasai et al. ..... 399/44

FOREIGN PATENT DOCUMENTS

JP 11-129582 * 5/1999

* cited by examiner

*Primary Examiner*—Hoang Ngo
(74) *Attorney, Agent, or Firm*—Robert E. Bushnell, Esq.

(57) ABSTRACT

The present invention relates to a method for improving a print quality of an image forming apparatus. The invention provides a method for improving the print quality of an image forming apparatus capable of preventing the deterioration of the print image according to the change of the environment condition around the image forming apparatus by controlling the print speed of the image forming apparatus in case that the environment condition is at a low temperature and low humidity when checked at the non-image stage of the apparatus. According to the present invention, it is checked whether or not the environment condition around the image forming apparatus is at a low temperature and low humidity at a non-image period prior to the beginning of print after the print data received externally are stored at a memory of the image forming apparatus. As a result of the above check, if the environment is at a low temperature and low humidity, it ensures the print quality under the environment by reducing the printing speed of the image forming apparatus. Therefore, a proper print image can be obtained in spite of the deviation of the environment condition around the image forming apparatus.

17 Claims, 2 Drawing Sheets

METHOD FOR IMPROVING THE PRINT QUALITY OF AN IMAGE FORMING APPARATUS

This application makes reference to, incorporates the same herein, and claims all benefits accruing under 35 U.S.C. § 119 from an application for METHOD FOR IMPROVING THE PRINT QUALITY OF AN IMAGE FORMING APPARATUS earlier filed in the Korean Industrial Property Office on the 7th day of the month of July 1999, and there duly assigned Ser. No. 27210/1999.

BACKGROUND OF THE INVENTION

1. Field of the Invention

The present invention relates to a method for improving the print quality of an image forming apparatus; and, more particularly, to a method for improving the print quality of an image forming apparatus capable of preventing the deterioration of the print image due to the change of the environment condition around the image forming apparatus by controlling the print speed of the image forming apparatus in case that the environment condition is at a low temperature and a low humidity when checked at the non-image stage of the apparatus.

2. Description of the Related Art

In general, facsimile, printer, and copy machines and a complex machine which performs these three functions, commonly have a printing function. All of them, therefore, essentially include an image forming apparatus for performing the printing function.

Such an image forming apparatus includes a paper cassette in which a plurality of papers as recording material are stacked. The papers stacked in the paper cassette are picked up and delivered, and an image is formed on the paper delivered through an image forming portion with dye such as toner. Then, the paper is output.

Typically, when activated, the image forming apparatus warms-up for a predetermined period depending on the property of the apparatus. When the warming-up is finished, the apparatus is converted to a on-line mode which can perform a print demand. If there is no print demand for a certain period at the on-line mode, the apparatus is converted from the on-line mode to a waiting mode. If the apparatus receives a print demand at the waiting mode, the apparatus performs the print operation by warming-up again. The warming-up, which is performed when the image forming apparatus is activated or receives a print demand in the waiting mode, means herein to pre-heat a transfer roller, a developing roller, a supplying roller and the like as well as an electrification roller of a printer engine actually performing the printing operation in the image forming apparatus by applying a predetermined voltage thereto.

However, since the above rollers are made of a conductive rubber material, the resistance of the rubber of the roller varies depending on the environment condition around the image forming apparatus. That is, since the temperature and the resistance of the rubber are in an inverse proportion relationship, the resistance of the rubber roller is increased in the case where the environmental condition around the image forming apparatus is a low temperature and low humidity condition.

Accordingly, since the respective rollers for forming a visible image by applying toner on an electrostatic latent image formed according to the externally received print data, transferring the visible image to a recording paper, and fixing the toner transferred to the recording paper, move the toner depending on the voltage difference applied to the rollers, if the resistance of each of the rollers increases under the external temperature or humidity, the amount of the toner applied to the electrostatic latent image decreases, thereby resulting in the deterioration of the image such as the decrease of the consistency of the image, the image contamination of non-image portion and the mistransfer. Such problems become even more severe in a mono developing roller system or a high speed developing system.

SUMMARY OF THE INVENTION

It is, therefore, a primary object of the present invention to provide an improved image formation process and apparatus.

It is another object to provide a process and apparatus for improving the print quality of materials produced.

It is still another object to provide a process and image forming apparatus capable of preventing the deterioration of the print image according to the change of the environment condition around the image forming apparatus by controlling the print speed of the image forming apparatus in case that the environment condition is at a low temperature and a low humidity when checked on at the non-image stage of the apparatus.

These and other objects may be attained in accordance with the principles of the present invention, with an image transfer process and apparatus that improves the quality of the printed images produced by the image forming apparatus by injecting toner onto an electrostatic latent image formed on a photosensitive drum according to print data received externally. The principles of the present invention contemplate the image forming apparatus storing in a memory the print data received externally and at the same time whether or not the environment condition around the image forming apparatus is at a low temperature and low humidity. When the environment condition is determined to be at a low temperature and low humidity, controlling the print speed of the image forming apparatus at a speed corresponding to the low temperature and low humidity environment; and printing the print data stored at the memory after the print speed is adjusted.

Preferably, the determining step includes detecting a resistance of a transfer roller of the image forming apparatus, and determining the environment to be at a low temperature and low humidity if the detected resistance change value is higher than a predetermined value.

Furthermore, the determining step includes measuring the internal temperature of the image forming apparatus, and determining the environment to be at a low temperature and low humidity if the measured temperature is increased above a predetermined value.

In addition, the print speed control step includes prestoring a print speed corresponding to the resistance or temperature at the memory, picking up and setting the print speed corresponding to the detected resistance or temperature from the memory.

BRIEF DESCRIPTION OF THE DRAWINGS

A more complete appreciation of the invention, and many of the attendant advantages, thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
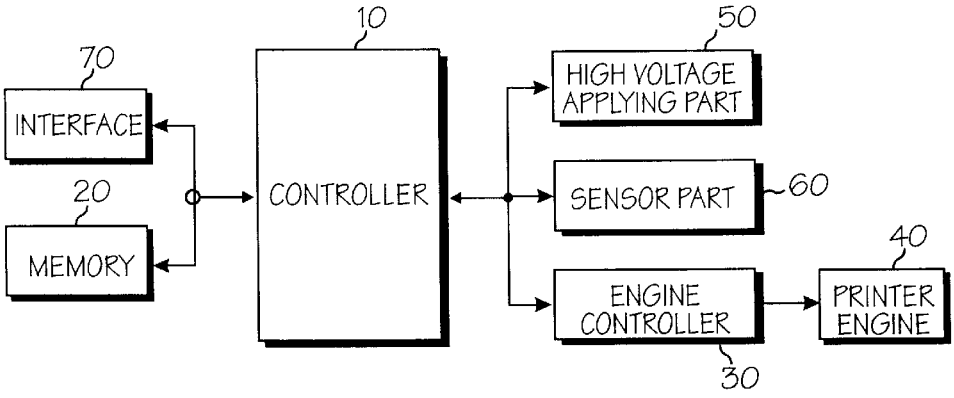
FIG. 1 is a schematic block diagram of an image forming apparatus which can be used in the practice of the present invention.

A preferred embodiment of the present invention will now be described with reference to the accompanying drawings. It should be noted that like reference numerals indicate like components in the drawings. Although specific components of the circuit are exemplified herein, it is apparent to those skilled in the art that it is not intended to limit the present invention and that the present invention may be practiced without the specific components.

Figure 2:
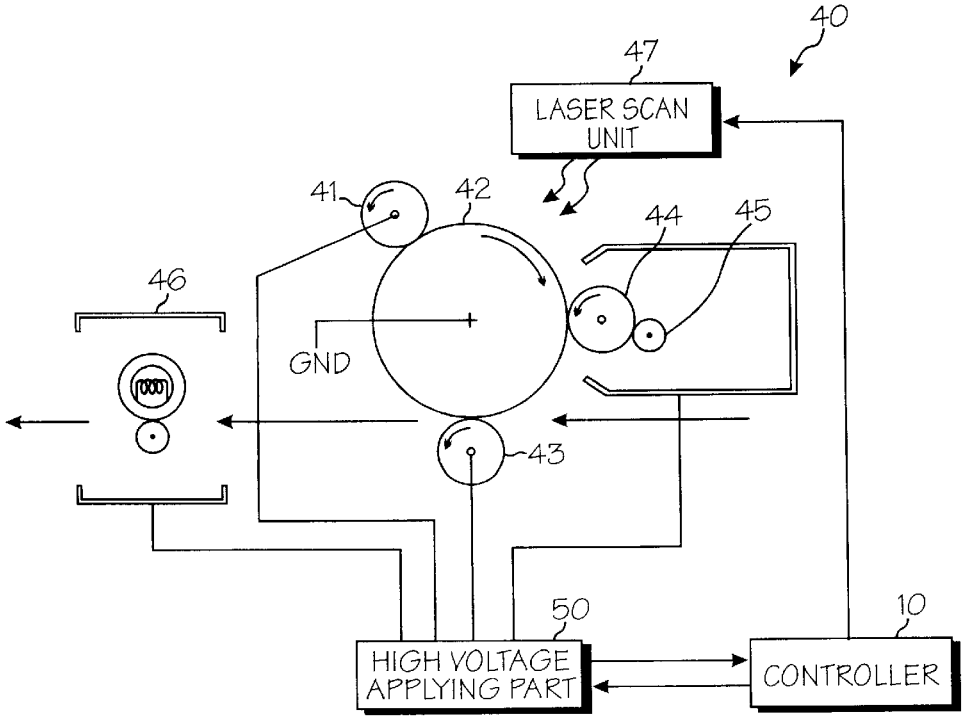
FIG. 2 schematically shows a printer engine of FIG. 1.
Figure 3:
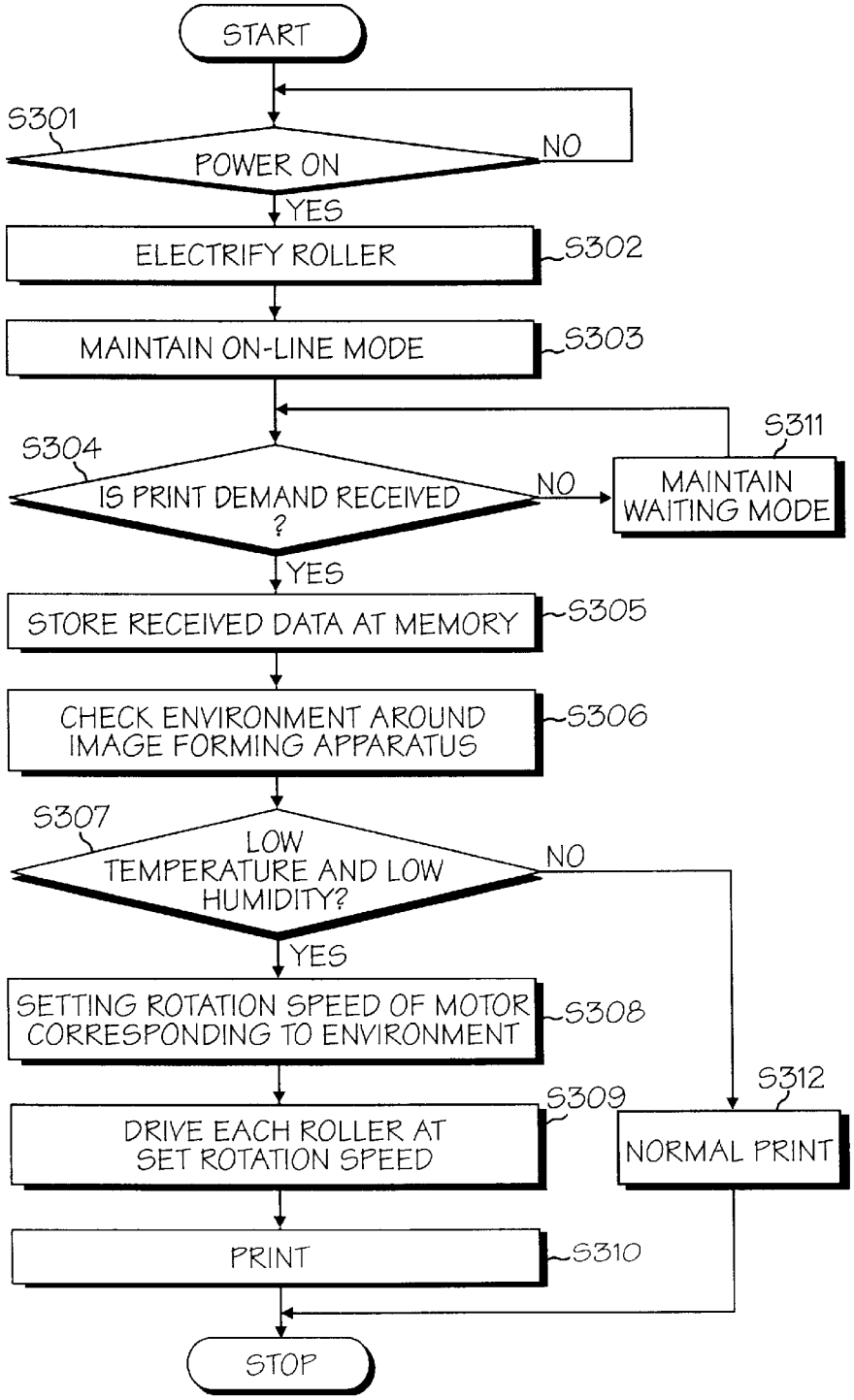
FIG. 3 is a flow chart of an image forming apparatus for improving the print quality according to the present invention.

FIG. 1 is a schematic block diagram of an image forming apparatus which can be used in the practice of the present invention; FIG. 2 schematically shows a printer engine of FIG. 1; and FIG. 3 is a flow chart of an image forming apparatus for improving the print quality according to the present invention.

Referring to FIG. 1, a controller 10 controls the operation of the image forming apparatus, and in particular controls each part of the image forming apparatus so as to prevent any misprint by adjusting the print speed when the environment condition around the apparatus is at a low temperature and low humidity.

A memory 20 stores various control programs required to performing the functions of the image forming apparatus and various data such as print data generated according to the operation of the control programs; and particularly stores in a look-up table form the environment condition around the image forming apparatus and a corresponding print speed, i.e., the environment condition around the image forming apparatus and driving speeds of various rollers corresponding thereto.

An engine controller 30 drives a printer engine 40 under the control of controller 10, and in particular controls the rotating speeds of motors driving the rollers of print engine 40, respectively in response to the signal from controller 10 to adjust the print speed. Print engine 40 actually performs the print operation under engine controller 40.

Print engine 40, as shown in FIG. 2, comprises an electrification roller 41, a photosensitive drum 42, a transfer roller 43, a developing roller 44, a supplying roller 45, a fixer 46 and a laser scan unit ("LSU") 47.

A high voltage applying part 50 applies a given voltage to each roller of printer engine 40 under the control of controller 10. In a typical image forming apparatus, an electrification voltage of −1.4 kV is applied to electrification roller 41, a transfer voltage of +2.0 kV to transfer roller 43, a developing voltage of −300 V to developing roller 44 and a supplying voltage of −500 V to supplying roller 45.

A sensor part 60 detects the paper jam in printer engine 40, the empty of paper or the like to send the detected result to controller 10. According to a preferred embodiment of the present invention, sensor part 60 comprises a temperature sensor for measuring the internal temperature of the image forming apparatus.

An interface 70 connecting the image forming apparatus to a computer, receives print data made externally.

The typical operation of printer engine 40 will now be described. The high voltage applying part 50 applies a given voltage to each roller 41, 43, 44, 45 and 46 of printer engine 40 of the image forming apparatus in response to the control signal from controller 10. Thus, electrification roller 41 electrified with a high electrification voltage uniformly electrifies a photosensitive material formed around the periphery of photosensitive drum 42 while rotating. On the other hand, LSU 47 emits light by the ON state laser diode (not shown) therein in response to the signal from controller 10. With the light emitted from LSU 47, an electrostatic latent image to be printed is formed on the surface of photosensitive drum 42 electrified by the electrification roller. At this time, there is generated a voltage difference between the supplying roller to which a higher voltage is applied and developing roller 44 to which a lower voltage is applied. Due to the voltage difference, the negative charged toner moves from supplying roller 45 to developing roller 44, and the toner moving to developing roller 44 is coated on the electrostatic latent image formed on the surface of photosensitive drum 42 to form a visible image. The visible image formed by the toner coated on the surface of photosensitive drum 42 is then transferred to the delivered recording paper by the high voltage of transfer roller 43, the visible image transferred to the recording paper is fixed to the paper by high temperature and pressure at the fixer 46, and the printing process is completed.

The operation of the present invention including such an arrangement will now be described in detail with reference to FIG. 3.

First, when a power switch is turned on and the image forming apparatus is activated (S301), high voltage applying part 50 applies the electrification voltage(−1.4 kV), the developing voltage (−300 V), the transfer voltage(+2.0 kV) and the supplying voltage(−500 V) to the corresponding rollers of the image forming apparatus, respectively in a predetermined order under the control of the controller 10 to electrify each roller (S302). After a certain warming-up time has been lapsed, the image forming apparatus is maintained in an on-line mode (S303).

Subsequently, controller 10 checks whether or not any print demand is received in a predetermined time in the on-line mode, and, if received, stores the print data received externally via interface 70 in memory 20 (S305).

Controller 10 stores in memory 20 the print data received from the computer and at the same time checks the environment condition around the image forming apparatus at the non-image stage to determine whether or not the environmental condition has low temperature and low humidity (S307).

As used herein, the term "non-image stage" refers to the stage prior to the performance of the print operation for the print data after the reception of the print demand at the on-line mode.

Further, a suitable method for checking the environment condition around the image forming apparatus can be selected depending on the environment condition, and includes, e.g., a method for checking the variation of the resistance of the various rollers which varies in accordance with the environment temperature around the image forming apparatus or a method for directly checking the internal temperature of the image forming apparatus by using a temperature sensor.

In this embodiment, a method for checking the environment condition around the image forming apparatus by applying a constant voltage to the transfer roller 43 to which the transfer voltage is applied, among the rollers whose resistance varies depending on the environment condition and measuring the current flowing through the transfer roller to detect the variation of the resistance of the transfer roller according to the variation of the current. That is, if the resistance of transfer roller 43; similar to that of a semiconductor of $10^5$ to $10^9$ ohm, is increased above a predetermined range, the controller determines that the environment condition around the image forming apparatus is at a low temperature and low humidity.

If the environment condition around the image forming apparatus is determined to be at a low temperature and low humidity, controller 10 sets the rotation speed of the motors (not shown) driving the corresponding rollers of printer engine 40 at a rotation speed suitable to the environment condition around the apparatus (S308). The method for properly setting the rotation speed of the driving motor according to the environment condition includes pre-storing a proper speed of the driving motor of each of rollers 41, 43, 44, 45 and 46 such as transfer roller 43 corresponding to the variation of the resistance of transfer roller 43, e.g., in a look-up table form in memory 20 and selecting the most proper driving speed corresponding to the environment condition around the image forming apparatus among the pre-stored speed values at memory 20 depending on the check result of the environment condition around the image forming apparatus according to the present invention. In addition, higher the resistance of transfer roller 43, i.e., lower the environment temperature of the image forming apparatus, slower the rotation speed of the rollers.

If the rotation speed of the motor suitable to the environment condition around the image forming apparatus is set, controller 10 transfers a predetermined signal according to the detected rotation speed of the motor to the engine controller 30, and the corresponding roller is driven at a speed suitable to the environment condition of the image forming apparatus under the control of engine controller 30 (S309).

If the control of the print speed according to the environment condition is finished, i.e., the print speed is set at a speed suitable to the low temperature and low humidity environment, the image forming apparatus performs the printing operation for the print data stored at the memory (S310) and stops the printing process upon the completion of the print.

On the other hand, if no print demand is received for a predetermined time at step 304 (S304), the process returns to step S304 where it is checked whether or not the print demand is received in the waiting mode. If there is no print demand, the waiting mode is maintained, but if the print demand is received, the process proceeds to step S305 where the received data are stored at the memory and the print work is performed.

Further, if the environment is determined to be not at a low temperature and low humidity as a result of the determination at step S307 where it is determined whether or not the environment is at a low temperature and low humidity, a normal print work is done (S312).

Accordingly, according to the present invention, in case the environment condition around the image forming apparatus is at a low temperature and humidity, it is possible to prevent the deterioration of the image by adjusting the print speed suitable to the environment.

Although the invention has been shown and described with respect to the preferred embodiments of the present invention, it will be understood by those skilled in the art that various changes and modifications may be made without departing from the spirit and scope of the invention as defined in the following claims. Therefore, the present invention should not be limited to the above described embodiments and is defined by the appended claims and the equivalent thereof.

What is claimed is:

1. A method for improving the print image of an image forming apparatus performing its printing work by injecting toner onto an electrostatic latent image formed on a photosensitive drum according to print data received externally, the method comprising the steps of:

storing in a memory the print data received externally and at the same time determining whether or not the environment condition around the image forming apparatus is at a low temperature and low humidity;

controlling the print speed of the image forming apparatus at a speed corresponding to the low temperature and low humidity environment in case that the environment condition is determined to be at a low temperature and low humidity; and printing the print data stored in the memory after the print speed is adjusted.

2. The method according to claim 1, wherein the determining step comprises detecting a resistance of a transfer roller of the image forming apparatus, and determining the environment to be at a low temperature and low humidity if the detected resistance value is increased above a predetermined value.

3. A method for controlling an image forming apparatus, comprising the steps of:

storing in a memory a print data received externally and at the same time determining the environmental condition around the image forming apparatus; and controlling the print speed of the image forming apparatus according to the determined environmental condition, said step of determining the environmental condition comprising the step of:

detecting a resistance of a transfer roller of the image forming apparatus.

4. The method of claim 3, said step of determining the environmental condition comprising the step of:

measuring the internal temperature of the image forming apparatus with a temperature sensor.

5. The method of claim 3, further comprising:

pre-storing in a memory a look up table of driving motor speeds for rollers of the image forming apparatus according to different values of said resistance of the transfer roller; and said step of controlling the print speed further comprising:

recalling the look up table values corresponding to the determined resistance of the transfer roller; and controlling rollers of the image forming apparatus according to the recalled look up table values.

6. The method of claim 5, further comprising:

driving the rollers of the image forming apparatus more slowly at higher determined values of resistance of the transfer roller.

7. The method of claim 3, said step of determining the resistance of the transfer roller further comprising:

applying a constant voltage to the transfer roller; and measuring the current flowing through the transfer roller.

8. The method of claim 3, said step of controlling the print speed further comprising:

when the environment is determined to be a low temperature and low humidity environment, then controlling the print speed to a speed different from the normal print speed; and when the environment is determined to not be a low temperature and low humidity environment, then controlling the print speed to a normal print speed.

9. The method of claim 4, said step of controlling the print speed further comprising:

when the environment is determined to be a low temperature and low humidity environment, then controlling the print speed to a speed different from the normal print speed; and when the environment is determined to not be a low temperature and low humidity environment, then controlling the print speed to a normal print speed.

10. The method of claim 4, further comprising:

pre-storing in a memory a look up table of driving motor speeds for rollers of the image forming apparatus according to different values of said resistance of the transfer roller; and said step of controlling the print speed further comprising:

recalling the look up table values corresponding to the determined resistance of the transfer roller; and controlling rollers of the image forming apparatus according to the recalled look up table values.

11. The method of claim 10, further comprising:

driving the rollers of the image forming apparatus more slowly at higher determined values of resistance of the transfer roller.

12. The method of claim 4, said step of determining the resistance of the transfer roller further comprising:

applying a constant voltage to the transfer roller; and measuring the current flowing through the transfer roller.

13. A method for controlling an image forming apparatus, the method comprising:

receiving print data externally and storing the received print data;

during said storing, determining environmental condition of an image forming apparatus; and controlling print speed of the image forming apparatus according to the determined environmental condition;

said determining including at least one selected from among detecting temperature with a sensor and detecting resistance of at least one roller of the image forming apparatus.

14. The method of claim 13, said at least one roller corresponding to a transfer roller.

15. A method for improving the print image of an image forming apparatus, the method comprising:

storing in a memory print data received externally and determining whether environment conditions around an image forming apparatus is at a low temperature and low humidity, said determining being performed during said storing;

controlling print speed of the image forming apparatus at a speed corresponding to the low temperature and low humidity environment when the environment condition is determined to be at a low temperature and low humidity; and printing the print data stored in the memory after the print speed is adjusted, said determining including at least one selected from the group consisting of detecting temperature with a sensor and detecting resistance of at least one roller of the image forming apparatus.

16. The method of claim 15, the environment conditions being determined to be at the low temperature and low humidity when the detected resistance is above a predetermined.

17. The method of claim 16, said at least one roller corresponding to a transfer roller.

* * * * *